United States Patent [19]

Gellatly

[11] Patent Number: 4,736,473

[45] Date of Patent: Apr. 12, 1988

[54] PRESSURE DRAIN CLEANER

[76] Inventor: Walter L. Gellatly, 3462 Jefferson, Ogden, Utah 84403

[21] Appl. No.: 818,007

[22] Filed: Jan. 13, 1986

[51] Int. Cl.[4] ..... B08B 9/02

[52] U.S. Cl. ..... 4/256; 239/288.5; 239/600; 285/331

[58] Field of Search ..... 4/255, 256, 257; 134/166 R, 166 C, 169 R, 169 C, 167 R, 167 C, 170; 239/104, 120, 121, 122, 288.3, 288.5, 289, 600; 141/382, 383, 384; 285/331

[56] References Cited

U.S. PATENT DOCUMENTS

| | | | |
|---|---|---|---|
| 383,964 | 6/1888 | Mackintosh | 134/170 |
| 1,074,706 | 10/1913 | Ferguson | 285/331 |
| 1,085,052 | 1/1914 | Lunney | 4/255 |
| 2,233,378 | 2/1941 | Wilson | 4/256 |
| 3,449,783 | 6/1969 | Kirschke | 134/167 R X |
| 3,672,380 | 6/1972 | Schuster | 4/256 X |
| 4,146,058 | 3/1979 | Bercovitz | 239/288.5 X |
| 4,212,335 | 7/1980 | Bova | 141/384 X |

*Primary Examiner*—Philip R. Coe

*Attorney, Agent, or Firm*—B. Deon Criddle

[57] ABSTRACT

A pressure drain cleaner including an integral nozzle, coupler and hose attachment fitting with the coupler being sized and shaped to connect to pipes of plumbing systems and to receive a suction attachment that will grip drains of the plumbing systems and that will be moved into a gripping relationship by flow therethrough.

1 Claim, 1 Drawing Sheet

PRESSURE DRAIN CLEANER

BACKGROUND OF THE INVENTION

1. Field of the Invention

The present invention pertains to plumbing and is particularly concerned with the cleaning and opening of drain systems.

2. Prior Art

Drain cleaning systems known to the prior art generally fall into one of three categories. First, there are a wide variety of chemical cleaners that use strong and dangerous acids or bases to chemically attack any material blocking the drain. These cleaners include chemicals that are necessarily extremely corrosive and some of those used such as sodium hydroxide, also generate large amounts of heat which cause water splattering as well as damage to plastic pipes.

A second category of systems uses mechanical devices such as augers on flexible shafts to physically bore through clogging debris Third, there are systems using pressure-oriented devices that introduce high pressure gasses into a clogged drain pipe in an attempt to dislodge the clogging material. These devices have limited utility and do not adequately deal with the problem of blow back of water and debris in the drain.

It has also been known to use water pressure by inserting the discharge end of a garden hose into a drain, stuff rags or the like around the inserted end to provide a seal, and to direct flow through the hose into the drain to dislodge any obstruction.

The known systems are expensive to construct, difficult and cumbersome to use, have the potential of damaging a piping system and/or do not work effectively. Desirably a drain cleaning device should be simple and inexpensive to manufacture and use and should be safe to plumbing systems.

OBJECTS OF THE INVENTION

A principal object of the present invention is to provide a pressure drain cleaner, adapted to use water, under pressure, as a clean out medium.

Another object of the present invention is to provide a pressure drain cleaner that is simple and inexpensive to manufacture.

Still another object of the present invention is to provide a pressure drain cleaner that will not damage piping systems.

Other objects of the present invention are to provide a pressure drain cleaner that is safe and easy to use and that will effectively seal the drain system against back pressure discharge and that will securely seal around drain entrances or alternatively can be threaded to a pipe of the drain system for use.

FEATURES OF THE INVENTION

Principal features of the present invention include a body having a hose attachment fitting at one end adapted to receive a discharge end of a hose and a coupler at another end adapted to be connected to a pipe of a drain system. An axially mounted nozzle, integral with the fitting, directs a high velocity stream of water. A suction attachment snaps to the coupler so that flow through the coupler directed therethrough and facilitates securing of the drain cleaner to a drain inlet.

The discharge end of an ordinary garden hose, or the like, can be coupled to the hose attachment fitting or to a valve attached to the fitting. An enlarged coupler is integrally connected to the hose attachment fitting and nozzle is interiorly threaded to be coupled to an exteriorly threaded pipe of a plumbing system.

Water supplied by an attached garden hose is directed into the nozzle, where its velocity is increased and from which it is directed into a clogged drain system. The high pressure jet of water through the nozzle works to unclog the drain. The interior threads of the coupler may be connected to the exterior threads of a pipe of a plumbing system, such as to a pipe to which the usual trap is attached so the water pressure can be directed through the system. Alternatively the suction attachment can be snap connected to the coupler, the suction cup thereof can be placed over a drain entrance and the water can be turned on. A control valve may be attached between the hose attachment fitting and a hose to facilitate control of water flow by a user. Flow through the nozzle acts as a Venturi to remove air from beneath the suction cup and to secure the cup to the surface surrounding the drain.

Other objects and features of the invention will become apparent from the following detailed description and drawing disclosing what are presently contemplated as being the best modes of the invention.

THE DRAWING

In the drawing

Figure 1:
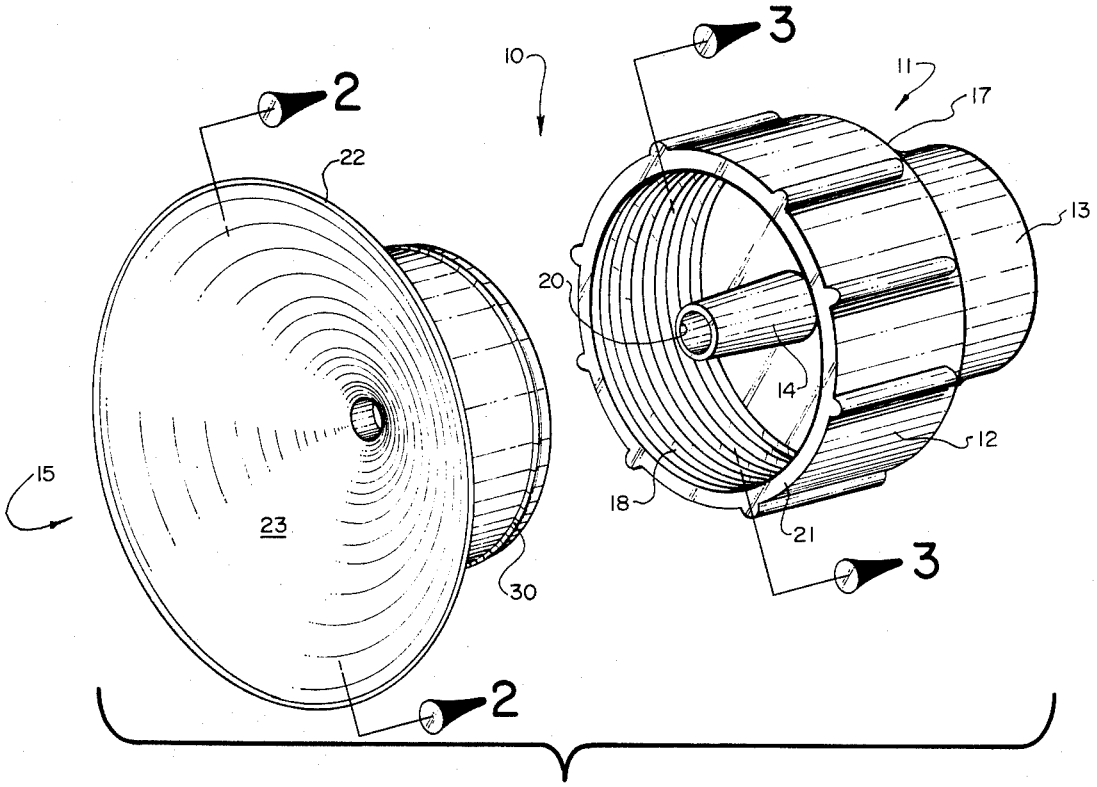
FIG. 1 is an exploded perspective view of the pressure drain cleaner of the invention.
Figure 2:
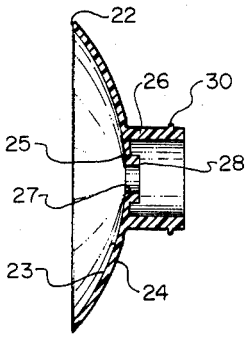
FIG. 2, is a cross sectioned view taken on line 2—2 of FIG. 1.
Figure 3:
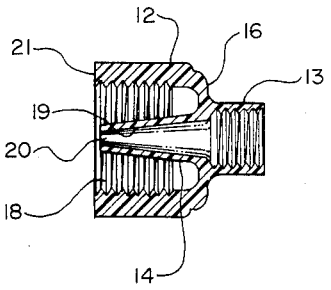

FIG. 3, a similar view taken on the line 3—3 of FIG. 1; and

Figure 4:
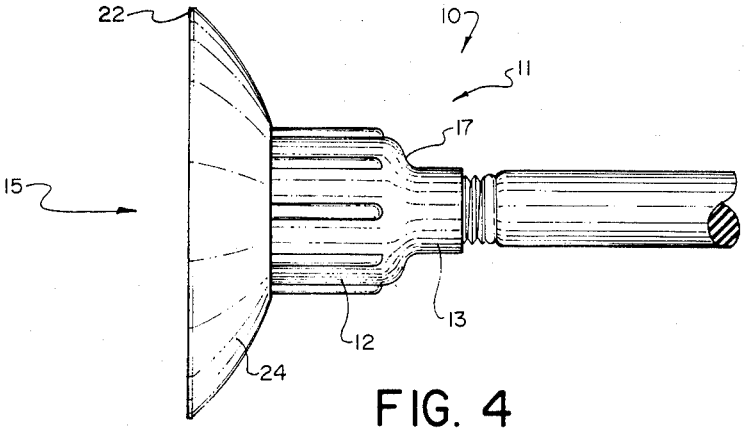

FIG. 4, side-elevation view of the invention, including a control valve.

DETAILED DESCRIPTION OF THE DRAWING

Referring now to the drawing

In the illustrated preferred embodiment the cleaner of the invention shown generally at 10 includes a body 11 with a coupler 12, hose attachment fitting 13, nozzle 14 and suction attachment 15. The body 11 also has a shoulder 16 integral with the hose attachment fitting 13, the coupler 12 and the nozzle 14. The fitting 13 is interiorly threaded to accept the exteriorly threaded discharge end of an ordinary garden hose, or the like (not shown), or to accept the exteriorly threaded end of a control valve 17 (FIG. 4) to which a hose may be attached. At the other end of the body 11 the coupler 12 is provided with interior threads 18 that will connect to an exteriorly threaded pipe (not shown) such as is common to plumbing systems.

The nozzle 14 has a passageway 19 therethrough aligned with an opening through the hoze attachment fitting and converging away from the fitting. The tip 20 of the nozzle is essentially in the plane of the outermost edge 21 of the coupler.

The suction attachment 15 includes a suction cup 22 of a flexible material, such as plastic, and has a generally concave face 23 and convex rear surface 24. A flat wall 25 is formed on the rear surface centrally thereof and extends into a sleeve 26 that projects from the rear surface.

An opening 27 is provided centrally through the suction cup and wall 25 and a lip 28 projects from wall 25 around the opening 27.

A resilient ring 30 surrounds sleeve 26 near the free end thereof. The ring 30 cooperates with the threads 18 of coupler 12 to hold the suction attachment means to the body 11, as will be further explained.

In use the body 11 can be used without the suction attachment 15 to clean drain systems. When so used, the coupler 12 is threaded onto a pipe (not shown) of a plumbing system and a water supply hose is threaded into the hose attachment fitting 13. Water is turned on, either by operation of the valve 17 or by a more remotely located control valve (not shown) and is directed through nozzle 14 into the plumbing system.

The body 11 can also be used with the suction attachment 15. To secure the attachment to the body the user inserts sleeve 26 into coupler 12. The sleeve fits snugly therein and the ring 30 yields during insertion and when the sleeve is fully inserted snaps into a groove of the threads 18 to hold the attachment from the body it is only necessary to turn the attachment while holding the body, thereby unthreading the sleeve from the coupler.

When the suction attachment is fully connected to the body the nozzle 14 extends through lip 28 and into wall 25. If the suction cup is then placed over a drain opening and water is directed through the nozzle, as previously described, air from beneath the face 23 is evacuated by the Venturi effect created by the water. The suction cup is then firmly seated over the drain opening and seals the same to prevent reverse flow.

With or without the suction attachment the high velocity stream of water through the nozzle works to dislodge any debris that is clogging a drain to which the cleaner is attached.

The cleaner 10 offers a number of advantages over prior pressure drain cleaners. The use of convergent nozzle 16 provides more effective cleaning than the standard practice of simply putting a hose into the drain. In addition, the present invention has proven to be as effective as mechanical "snakes" without the bother of expensive apparatus often associated with such devices. Also, the use of ordinary water as a working fluid is inexpensive, readily available and non-toxic. Further with the removable suction attachment device in place the device is easily secured to a drain for a cleaning of a plumbing system, whereas, when the attachment is removed the cleaner is readily attaced to a pipe for cleaning of such a system.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A pressure drain cleaner comprising a body having a coupler with an interiorly threaded coupler outlet at one end and an interiorly threaded hose attachment fitting at the other end;

a nozzle centrally positioned within the coupler and formed as one piece with the coupler and hose attachment fitting, said nozzle having a passageway therethrough with an inlet end in communication with an interior of the hose attachment fitting and a discharge end, whereby flow from a hose attached to the hose attachment fitting will flow through the nozzle and with the coupler outlet larger than the hose attachment fitting whereby the coupler outlet is large enough to be threaded onto a plumbing drain; and a suction attachment comprising a suction cup having generally a convex rear surface and a concave front surface, a sleeve extending from the rear surface, a resilient ring extending around the sleeve, said sleeve being removably inserted into the coupler and said ring locking into an interior thread of the coupler, a bore through the sleeve and the suction cup and the nozzle extending into the bore.

* * * * *